US005407337A

United States Patent [19]

Appleby

[11] Patent Number: 5,407,337

[45] Date of Patent: Apr. 18, 1995

[54] HELICAL GEAR FLUID MACHINE

[75] Inventor: Derek Appleby, Mossley, United Kingdom

[73] Assignee: Mono Pumps Limited, Manchester, United Kingdom

[21] Appl. No.: 249,155

[22] Filed: May 25, 1994

[30] Foreign Application Priority Data

May 27, 1993 [GB] United Kingdom ..... 9310949

[51] Int. Cl.[6] ..... F01C 1/10

[52] U.S. Cl. ..... 418/166; 418/48

[58] Field of Search ..... 418/48, 102, 166

[56] References Cited

U.S. PATENT DOCUMENTS 4,397,619 8/1983 Alliguander et al. ..... 418/48

4,778,080 10/1988 Ono et al. ..... 418/48

FOREIGN PATENT DOCUMENTS 0302189 12/1988 Japan ..... 418/48

5087059 4/1993 Japan ..... 418/166

*Primary Examiner*—Richard A. Bertsch

*Assistant Examiner*—Charles G. Freay

*Attorney, Agent, or Firm*—Harness, Dickey & Pierce

[57] ABSTRACT

A helical gear fluid machine comprises an inner rotary element (14) and an outer rotary element (15) and a casing (12), the rotary elements being mounted within the casing for rotation about mutually spaced fixed axes (17,16), The casing forms stationary inlet and outlet chambers (21,24) to the working section of the machine. The inner rotary element (14) is only supported for rotation by means of the outer rotary element (15) and by means of a coupling (28) with the drive shaft.

5 Claims, 1 Drawing Sheet

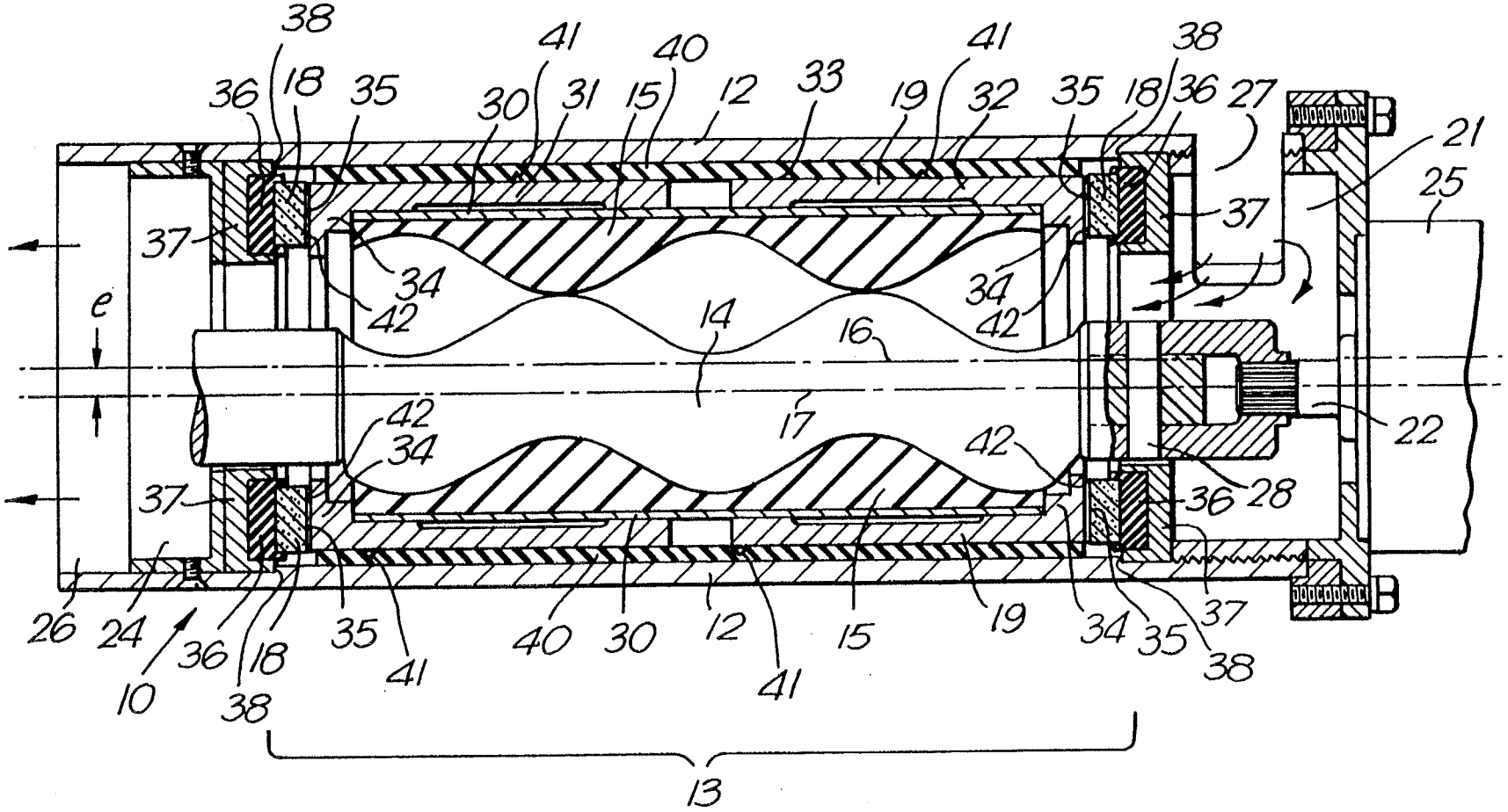
21
25
22
27
28
37
36
38
18
35
34
42
41
32
19
16
15
17
33
12
14
13
40
30
31
10
24
26
e

HELICAL GEAR FLUID MACHINE

BACKGROUND OF THE INVENTION

This invention relates to a helical gear fluid machine, such as pump or motor, of the progressive cavity type, in which, generally, a rotor of n starts is caused to rotate and orbit within the stator of n±1 starts. Alternatively, it has been suggested in U.S. Pat. No. 1,892,217 to produce a pump or motor in which the stator, the outer element, rotates, rather than being fixed, and forms the outer casing of a chamber in which the rotor rotates about a fixed axis, and through which the fluid is pumped.

The casing of the chamber is supported for rotation about its axis by plates forming the inner part of the end walls of the chambers at either end of the pump, through which fluid passes, on the outside of the pump casing. In this suggestion, fluid is admitted to or from the casing through these supporting end walls, which are shown as the inlet/outlet ducts of the pump. O-rings are provided to support the thrust bearings between its supports and the casing, to allow for axial misalignment and at the entry of the drive shaft for the inner element.

SUMMARY OF THE INVENTION

According to the present invention there is provided a helical gear fluid machine comprising a fixed outer casing, an outer rotary element having a female helical gear form of n starts, the outer rotary element being supported for rotation about a first fixed axis defined by the fixed rotor casing, an inner rotary element having a male helical gear form of n±1 starts, the inner rotary element being adapted for rotation within the outer rotary element about a second, fixed axis, said second axis being spaced apart from and substantially parallel to the first axis wherein the inner rotary element is only supported for rotation by means of the outer rotary element and by means of coupling with the drive shaft.

With the present invention, the casing of the pump is fixed, and the outer rotating element is supported radially and axially for rotation within it. The inner rotary element, corresponding to the rotor of conventional rotating and orbiting pumps may be driven for rotation about the axis defined by the drive shaft. The inner rotary element is supported by and engages the outer rotary element.

Whereas the prior art pump needs four seals and six bearings to operate, only one seal, to seal the drive shaft, and three process lubricated bearings are needed for the operation of the pump of the invention.

As compared with conventional helical gear pumps, in which the inner element or rotor rotates and orbits within a stationary stator, the drive shaft arrangement is especially simple, since the rotor may be driven directly from the drive shaft of the motor, or a gear box output, and no flexible coupling is required.

Conventionally, a flexible drive shaft involves a coupling which must generally be protected against the ingress of the fluid being pumped, or the pressurised fluid driving the motor. Hence, the arrangement of the present invention is considerably simpler than the conventional orbiting rotor type of fluid machine. Also the overall pump length is less than any similar prior progressive cavity pump, thereby reducing manufacturing costs and the contained fluid volume.

Further, as compared with the conventional type of pump, the present invention allows the rotor to turn at twice the speed of a conventional equivalent rotor, for the same cavity progression. Hence, the torque requirement is half that of a conventional pump, and a smaller motor may be used.

This finds particular application in downhole bore pumps, where the space necessary for a motor may not be available, and cavity pumps must in general be driven by a shaft from ground level. This is inconvenient, but with the present invention it is possible because of the reduction in the size of motor necessary to position the (electric) motor next to the pump in the bore hole equipment, the only connection to the surface in addition to the delivery tube being the power lines for the motor.

The adoption of this form of fluid machine is particularly advantageous when considering fluids whose properties may become undesirable when subjected to the centrifugal action of a conventional progressive cavity pump where the cavity follows essentially helical paths; in the present invention, the paths followed are essentially linear. Therefore, no centrifugal action occurs which can separate out more abrasive particles than would usually collect at the seal lines around the cavity. Hence, excessive wear between the rotor and stator may be avoided where fluids containing abrasive solids are encountered. With the present invention, the centrifugal action which tends to separate out these solids is not present.

As compared with U.S. Pat. No. 1,892,217, the inlet chamber is stationary, rather than rotating with the outer rotary element. Therefore, the present invention has a reduced tendency for suspended solids to remain in the inlet chamber, where they may cause wear. Rather, the radially inward flow of the fluid to be pumped means that fluid can pass continuously through the chamber with little tendency for pockets of fluid to stagnate.

Further, the only seal needed by the motor is a conventional seal as used commonly with submersible motors. The duty is very light because of the slight pressure differentials exerted across it.

BRIEF DESCRIPTION OF THE DRAWINGS

The invention will further be understood by reference to the following description, when taken together with the attached drawings in which the sole figure shows a cross section of a pump according to the invention.

DETAILED DESCRIPTION OF THE PRESENTLY PREFERRED EMBODIMENT

The pump has a casing 12, having a working section 13, in which are disposed an inner rotary element 14 having a male helical gear form of n±1 starts and an outer rotary element 15 having a female helical gear form of n starts, supported for rotation about respective axes 16 and 17 separated by a distance e (the eccentricity of the helical shape of the inner rotary element). The outer element 15 is supported by axial and radial bearings 18, 19 respectively, and the inner rotary element 14 is supported only by the outer rotary element 15 and the bearings of motor 25 via a coupling 28. Motor 25 is attached to the casing via an inlet chamber 21, through which passes drive shaft 22, which connects the motor to the inner rotary element. Radial inlet passages 27 are provided to admit fluid to the interior of the inlet chamber 21.

The outer rotary element 15 is formed of a hard elastomeric material, such as neoprene rubber, and this is moulded into a tubular metal barrel 30 in a conventional way. Force fitted onto the barrel are two bearing runners 31, 32 formed of hard chromium plated tool steel, each runner having a cylindrical outer surface 33 and a radially inwardly directed shoulder 34, the two shoulders having annular radially extending bearing surfaces 35. The axial bearings indicated by the general reference numeral 18 are each in the form of annular members which may, for example, be formed of 95% aluminium ceramic material to form a thrust bearing. These annular thrust bearings are each mounted in a compliant rubber resilient annular mounting 36, itself supported by an L cross-section supporting ring 37 engaged against a shoulder 38 in the outer casing 12.

The inner surface of the casing 12 has a moulded in compliant rubber bearing member 40 which acts as the radial bearing. The inner surface of this compliant rubber bearing member 40, which thus forms the radial bearing 19, is formed with a helical groove 41. The axial ends of the annular thrust bearings 18 which abut the bearing surface 35 of the associated runner are provided with grooves 42 which may, for example, be simple radial grooves.

It will be appreciated that in this way as material is pumped it will be under pressure at the lefthand end as shown in the drawing and a very small proportion of the pumped fluid will leak through the grooves 42 in the downstream thrust bearing 18, which thus acts as a flow inhibitor, and then will flow axially towards the inlet in the helical groove 41 in the compliant rubber sleeve 40 and thence radially inwardly in the grooves formed in the thrust bearing 18 at the inlet end.

At the left hand end of the working section 13, an outlet chamber 24 connects to an outlet 26, which can be connected to, say, a non return valve for improved pumping.

A coupling 28 is used for ease of-assembly between the motor shaft and the head of the rotor. Since the axis of the rotor is fixed, the connection may be a plain one, via a dog clutch or gudgeon, and need not be protected from the fluid. Alternatively the coupling may be splined or keyed. For convenience, the connection may be made within the inlet chamber, or may be disposed outside the chamber beyond a seal, provided on shaft 22 in a conventional manner further reducing the wear on the connection.

In use, the motor drives the inner rotary element about its axis, causing the outer rotary element to rotate in accordance with a number of starts of each rotary element. The cavities between the two elements progress towards the left hand end of the working section as shown in FIG. 1, forcing the fluid to flow into the, outlet chamber and towards the non-return valve.

The rotor is constrained to rotate about a fixed axis, so that no out of balance forces are produced during operation of the pump. The rotor is constrained to remain aligned by the shape of the outer rotor, and is only deflected from its position slightly in response to reaction from the drive to the rotor. Beyond the first critical speed of the rotor, it tends to self-align, as any out of balance loads (within the inner rotor itself) become out of phase with its motion.

The outer rotor is, as described above, supported for rotation in a product-lubricated journal bearing, although this may be omitted and, for instance, rolling element bearings used instead. Where a journal is used, the critical speed of the outer rotor is lowered, because of the low stiffness of the mounting, and the amplitude of vibration resonance is reduced because of the damping of the fluid in the journal, leading to increased working life.

The virtual elimination of out of balance loads allows a very high inner rotor speed. Down-hole pumps must fit into a diameter determined by the diameter of the bore hole, and any accompanying motor must also fit within that diameter. Since the torque capacity of the motor is effectively limited by the diameter, the work which can be done by a directly connected pump is limited by its operating speed.

With a progressive cavity pump according to the present invention, the inner rotor may turn at up to 3000 rpm (which gives a relative rotational speed of 1500 rpm) in a 152 mm [6 inch] diameter bore hole pump (i.e. at equivalent speeds to a conventional centrifugal pump) and is therefore capable of operating at the same power with an equivalent direct motor coupling. The advantages of a progressive cavity pump are thus available without the previously encountered disadvantage of reduced power handling, due to the reduced speed of operation encountered in fixed stator pumps.

I claim:

1. A helical gear fluid machine comprising, in combination:

a fixed shaft;

a fixed outer casing, having a first drive shaft end and a second end, opposite said first drive shaft end;

an outer rotary element having a female helical gear form of n starts;

means supporting said outer rotary element for rotation about a first fixed axis defined by said fixed outer casing;

an inner rotary element having a male helical gear form of $n \pm 1$ starts, said inner rotary element being rotatable within the outer rotary element about a second, fixed axis, said second axis being spaced apart from and substantially parallel to the first axis, the inner rotary element being only supported for rotation by means of the outer rotary element and by means of coupling with the drive shaft; said outer rotary element comprising:

an elastomeric material body in which said female helical gear form is provided;

a surrounding tubular metal barrel, said outer rotary element having axial ends; and two bearing zones on said tubular metal barrel, one at each axial end of said outer rotary element, said bearing zones being axially spaced from one another;

an elastomeric material bearing member positioned between said bearing zones of said tubular metal barrel and said outer casing, effective to provide a radial bearing for said outer rotary element;

an annular radially extending bearing surface on said bearing zone at the first, drive shaft end of said outer casing; and an axially resiliently mounted axial annular thrust bearing mounted to said outer casing and engaging said annular radially extending bearing surface.

2. A helical gear fluid machine as claimed in claim 1, wherein said two bearing zones comprise two bearing runners force fitted onto said surrounding tubular metal barrel, one at each end thereof.

3. A helical gear fluid machine as claimed in claim 1, wherein each said bearing runner comprises a generally cylindrical outer surface and a radially inwardly directed shoulder, and wherein said annular radially extending bearing surface is formed on said radially inwardly directed shoulder.

4. A helical gear fluid machine as claimed in claim 1, wherein said elastomeric material bearing member comprises a molded-in compliant rubber member molded-in into the interior of said outer casing.

5. A helical gear fluid machine as claimed in claim 1, and further comprising means defining a helical groove on the interior surface of said elastomeric material bearing member, extending along the length thereof, a flow inhibitor located between said second end of said fixed outer casing and the adjacent end of said outer rotary element effective to allow a limited quantity of high pressure fluid to pass, via said flow inhibitor, to said helical groove thereby to flow axially to the first end of said outer casing and then radially inwardly over said annular bearing surface, thereby lubricating said bearing zone and said annular radially extending bearing surface.

* * * * *

UNITED STATES PATENT AND TRADEMARK OFFICE

CERTIFICATE OF CORRECTION

PATENT NO. : 5,407,337

DATED : April 18, 1995

INVENTOR(S) : Derek Appleby

It is certified that error appears in the above-indentified patent and that said Letters Patent is hereby corrected as shown below:

Column 3, line 39, "of-assembly" should be --of assembly--.

Column 3, line 55, delete ",".

Column 4, line 67, Claim 3, "1" should be --2--.

Signed and Sealed this

Eleventh Day of July, 1995

*Attest:*

*Attesting Officer*

BRUCE LEHMAN

*Commissioner of Patents and Trademarks*